US005548944A

United States Patent [19]

Prochut et al.

[11] Patent Number: 5,548,944

[45] Date of Patent: Aug. 27, 1996

[54] VACUUM OPERATED PROCESSING STATION HAVING A LIQUID SEPARATING SYSTEM

[75] Inventors: Richard Prochut, Bartlett; Jörgen Löfstedt, Palatine; Christer Nilsson, Arlington Heights, all of Ill.

[73] Assignee: Tetra Laval Holdings & Finance S.A., Pully, Switzerland

[21] Appl. No.: 315,405

[22] Filed: Sep. 28, 1994

[51] Int. Cl.[6] ..... B65B 31/02

[52] U.S. Cl. ..... 53/511; 53/79; 53/559; 137/171; 137/397; 210/143

[58] Field of Search ..... 53/510, 511, 79, 53/408, 405, 559; 137/204, 187, 171, 397, 396; 210/744, 97, 86, 258, 252, 143

[56] References Cited

U.S. PATENT DOCUMENTS

| | | | |
|---|---|---|---|
| 2,614,742 | 10/1952 | Price . | |
| 2,696,193 | 12/1954 | Domingo | 137/171 X |
| 2,784,748 | 3/1957 | Eichenlaub | 141/65 |
| 2,934,866 | 5/1960 | Conti et al. | 53/510 X |
| 3,285,297 | 11/1966 | Duft et al. | 141/54 |
| 3,664,086 | 5/1972 | James et al. | 53/511 |
| 3,916,936 | 11/1975 | Villaume et al. | 137/204 |
| 3,945,172 | 3/1976 | Johnson | 53/511 X |
| 4,336,821 | 6/1982 | Frantz et al. | 137/187 |
| 4,434,821 | 3/1984 | Bacroix | 141/44 |
| 4,505,288 | 3/1985 | Murphy, Jr. et al. | 137/397 X |
| 4,567,713 | 2/1986 | Natterer | 53/511 X |
| 5,031,673 | 7/1991 | Clüsserath | 141/6 |
| 5,218,838 | 6/1993 | Kitamoto et al. | 62/288 |
| 5,259,427 | 11/1993 | Grooms et al. | 141/95 |
| 5,311,726 | 5/1994 | Rauscher et al. | 53/511 |
| 5,362,403 | 11/1994 | Dosoudil | 210/143 X |

*Primary Examiner*—James F. Coan
*Attorney, Agent, or Firm*—McAndrews, Held & Malloy, Ltd.; Patrick N. Burkhart

[57] ABSTRACT

A vacuum operated processing station having a liquid separating system is set forth. The liquid separating system includes a separator tank disposed between a vacuum operated processing apparatus and an under-pressure source. The separator tank prevents liquid from reaching the under-pressure source. The system may be controlled to automatically drain the separator tank when the liquid level within the tank reaches a predetermined level.

34 Claims, 5 Drawing Sheets

VACUUM OPERATED PROCESSING STATION HAVING A LIQUID SEPARATING SYSTEM

TECHNICAL FIELD

The present invention relates to a vacuum operated processing station. More particularly, the present invention relates to a liquid separating system for protecting the under-pressure source of a vacuum operated processing station of a packaging machine.

BACKGROUND

In the packaging industry, many different types and sizes of containers are used for a wide variety of packaging applications. The process of filling and sealing these containers is a multi-step procedure in which the containers are formed, filled, and sealed.

One or more vacuum operated processing stations may be used to implement one or more of the processes required to form, fill, and seal the container, such as a gable top carton. One example of a vacuum operated processing apparatus for use at such a station is disclosed in U.S. Ser. No. 08/315,403 (Attorney Docket No. 10599US01—Corporate Docket No. TRX-0064), entitled "Vacuum Operated Bottom Former", filed on even date herewith, and which is hereby incorporated by reference. The foregoing application discloses a carton bottom forming apparatus that utilizes an under-pressure source to assist in forming the carton bottoms. More particularly, the bottom forming apparatus includes a plurality of cups that are in communication with an under-pressure source. Each of the cups includes an anvil disposed at the bottom thereof. Engagement between the cartons that are to be sealed and the cups forms a seal in each of the cups so that the carton bottoms are driven by the suction generated by the under-pressure source against the anvils. Engagement between the canon bottoms and the anvils results in the formation of a generally flattened seating area at the bottom of the carton.

Vacuum operated processing apparatus, such as the one just described, are subject to failure as a result of container leaks. If a container leaks, the leaking liquid is drawn towards the under-pressure source. Upon reaching the under-pressure source, the leaking liquid may cause severe damage to the under-pressure source necessitating costly repair and down time. An apparatus for preventing damage to the under-pressure source of such a vacuum operated processing apparatus is therefore set forth.

SUMMARY OF THE INVENTION

A vacuum operated processing station in a packaging machine that employs a liquid separating system is set forth. The vacuum operated processing station includes an under-pressure source that creates an under-pressure that is used to drive a vacuum operated processing apparatus that executes one of a plurality of processing steps to form, fill, and seal a container. To protect the under-pressure source from leaking liquid, the station utilizes a liquid separating system that includes a separator tank having an inlet in fluid communication with the vacuum operated processing apparatus and an outlet in fluid communication with the under-pressure source. The liquid separating system prevents leaking liquid from reaching and damaging the under-pressure source.

In accordance with one embodiment of the system, the separator tank is provided with a probe that is disposed through a side wall of the separator tank. The probe provides an output signal indicative of the level of fluid in the separator tank. This output signal is supplied to a controller which, upon detecting a liquid level in excess of a predetermined level, shuts down the under-pressure source and actuates the opening of a drain disposed in the bottom of the separator tank. After a predetermined period of time for draining has elapsed, the drain is closed and the under-pressure source is again activated.

Other advantages of the present invention will become apparent upon reference to the accompanying detailed description in conjunction with the following drawings.

DETAILED DESCRIPTION OF THE INVENTION

Figure 1:
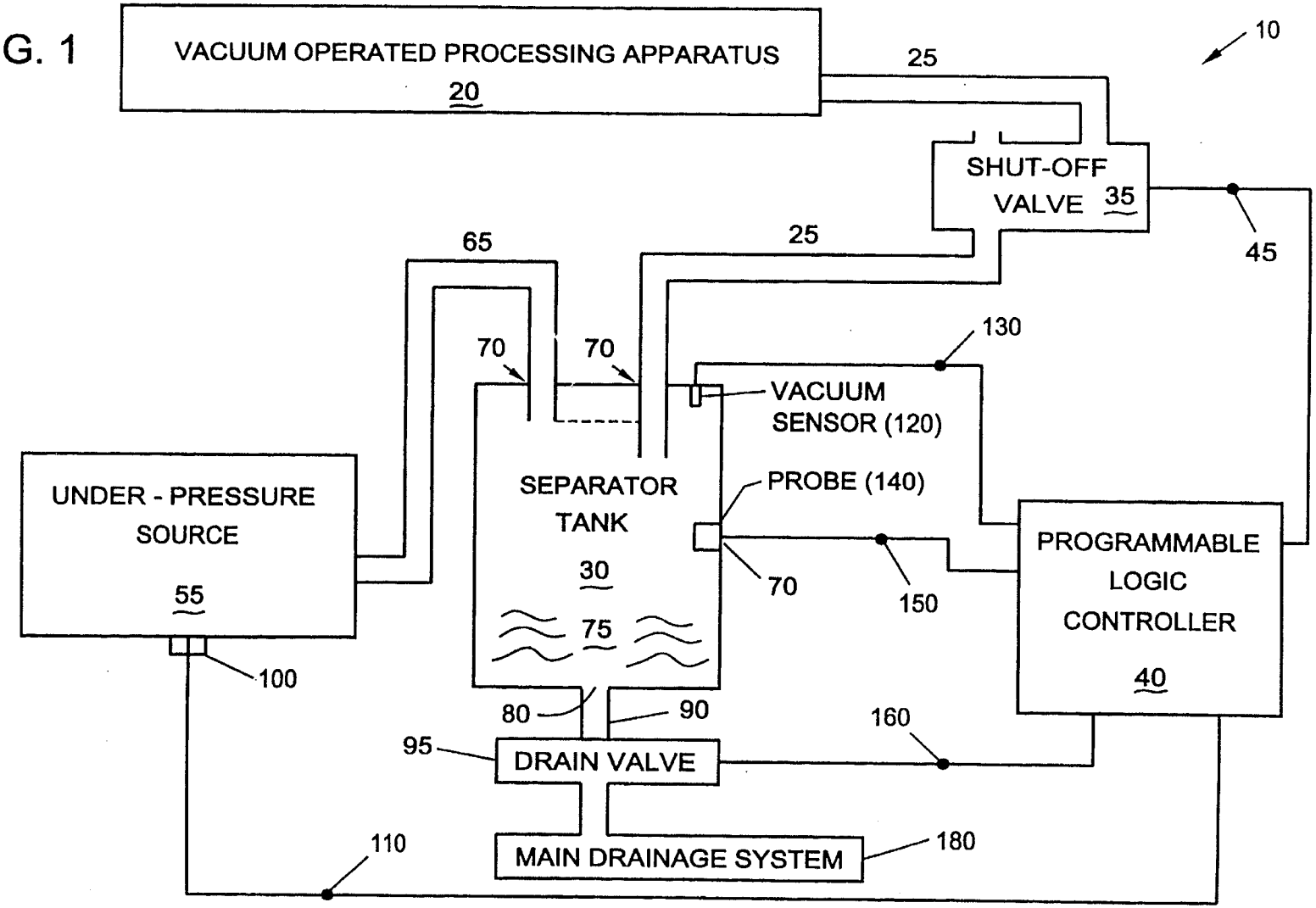
FIG. 1 is a block diagram of a vacuum operated processing station including a liquid separating system.

A block diagram of a vacuum operated processing station 10 is shown in FIG. 1. As illustrated, the processing station includes a vacuum operated processing apparatus 20. One such vacuum operated processing apparatus 20 is a vacuum operated bottom former such as the one disclosed in U.S. Ser. No. 08/315,403 (Attorney Docket No. 10599US01—Corporate Docket No. TRX-0064) previously incorporated by reference.

An inlet pipe or hose 25 provides fluid communication between the vacuum operated processing apparatus 20 and a separator tank 30. A shut-off valve 35 is disposed between the vacuum operated processing apparatus 20 and the separator tank 30 in line with hose 25. The shut-off valve 35 has an electronic input connected to receive a control signal from a programmable logic controller 40 along one or more lines 45. The shut-off valve 35 may, for example, be a 3/2 Valve Series 564 and 567 ND 12–25, G 1/2-1 Solenoid Operated device manufactured by Mannesmann Rexroth. The programmable logic controller 40 may, for example, be a Model 9070 manufactured by GE Fanuc, including a corresponding I/O interface card likewise available from GE Fanuc.

Figure 5:
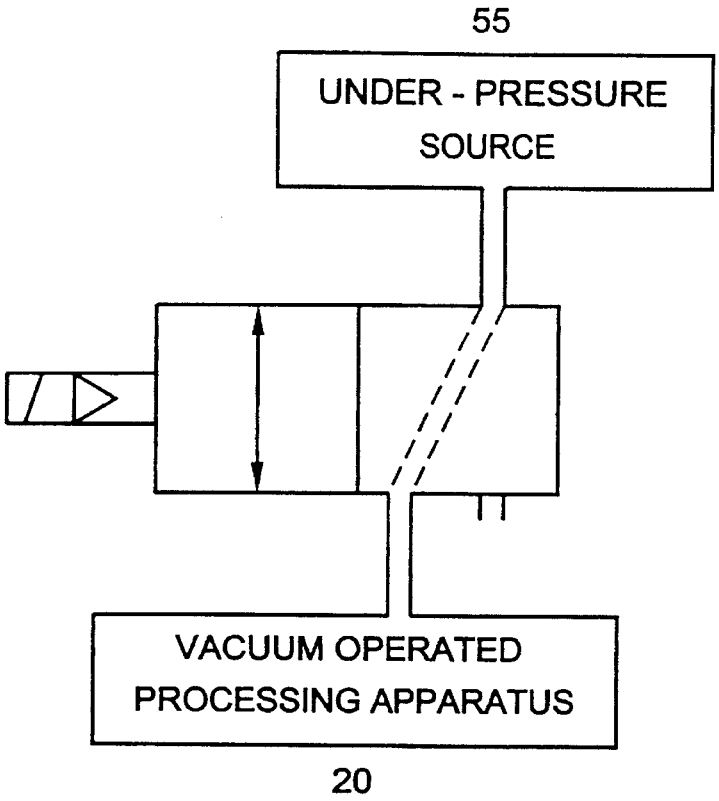
FIGS. 5 and 6 are block diagrams illustrating the operation of the shut-off valve.
Figure 6:
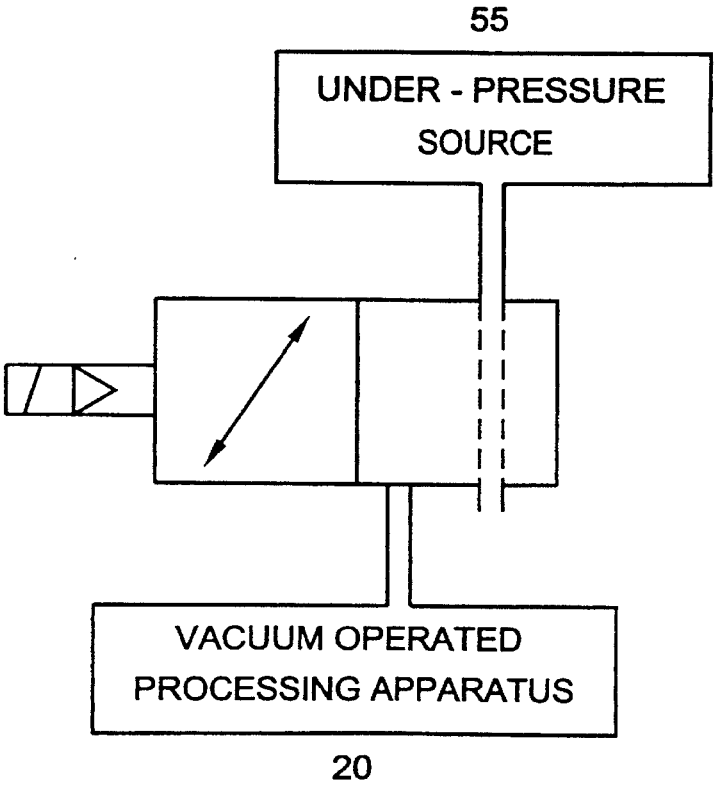

The shut-off valve 35 has three ports and two modes of operation. The shut-off valve toggles between each mode under control of the control signal that is received from the programmable logic controller 40 along line(s) 45. In a first mode of operation, the shut-off valve 35 allows fluid communication between the vacuum operated processing apparatus 20 and an under-pressure source 55 (FIG. 5). In a second mode of operation, the valve 35 isolates the vacuum operated processing apparatus 20 from source 55 by diverting the output of the under-pressure source 55 to the atmosphere (FIG. 6). When used with the vacuum bottom former 60 (FIG. 2), the former 60 is in fluid communication with the under-pressure source as the bottoms of the containers are being formed. Once the bottoms have been formed, however, the shut-off valve 35 may be used to isolate the vacuum operated bottom former 60 from source 55 to facilitate removing the containers from the cups.

The separator tank 30 is generally air-tight and includes two openings disposed at an upper portion thereof—a first opening receives the inlet hose 25 to allow the hose to protrude into the separator tank 30 while a second opening receives an outlet hose 65 allowing the hose to protrude into the separator tank 30. Both the inlet hose 25 and the outlet hose 65 openings are sealed by gaskets 70. As illustrated, the inlet hose 25 extends a greater distance vertically downward into the separator tank 30 as compared to the outlet hose 65. This prevents a liquid 75 that enters the separator tank 30 from being siphoned through the outlet hose 65. An opening 80 in the bottom of the separator tank 30 allows liquid that has accumulated to be discharged. An exit pipe or hose 90 provides fluid communication between the opening 80 and a drain valve 95.

The outlet hose 65 provides fluid communication between the separator tank 30 and the under-pressure source 55. The under-pressure source 55 supplies the vacuum pressure necessary for the operation of the vacuum operated processing apparatus 20. Power to the under-pressure source 55 is controlled by a relay or power switch 100 that, in turn, may be controlled by a control signal received from the programmable logic controller 40 along one or more lines 110.

The vacuum operated processing station 10 also includes a vacuum sensor 120 that is disposed, at least in part, inside the separator tank 30 at a position at which it can detect the under-pressure level in the separator tank 30. The vacuum sensor 120 provides an electronic output signal indicative of the under-pressure level along one or more lines 130 to the programmable logic controller 40. The vacuum sensor 120 may, for example, be a Vacuum Switch/Solid State Type ZSE2, manufactured by SMC.

The vacuum sensor 120 may be used, for example, to detect a breach in the vacuum system indicative of a failure of the station 20. For example, in the vacuum operated bottom former of the Ser. No. 08/315,403 application, a minimum level of under-pressure is required to properly form the containers. If a container fails to form a seal with the cups, the under-pressure level will be insufficient to properly form the bottoms of the remaining containers. The vacuum sensor 120 detects the low level of under-pressure and communicates the condition to the programmable logic controller 40 which, for example, may shut down the under-pressure source 55 and/or the overall packaging machine.

A probe 140 is disposed in the separator tank 30 to detect the level of liquid 75. The probe 140 protrudes through the side of the separator tank 30 at approximately the mid region thereof and is sealed by a gasket 70. The vertical position of the probe 140, however, may be altered dependent on the level of liquid that is to be detected by the probe 70 before the tank 30 is emptied. An output signal from the probe 140 is supplied to the programmable logic controller 40 along one or more lines 150. If the liquid 75 in the separator tank 30 reaches the level of the probe 140, the output signal along line(s) 150 goes to an active state or, for example, changes its resistance, thus indicating to the programmable logic controller 40 the need to empty the tank 30.

The drain valve 95 is disposed below the separator tank 30 and has an input connected to receive a control signal from the programmable logic controller 40 along one or more lines 160. The drain valve 95 may, for example, be a GHAP type pneumatic valve that is commercially available.

The drain valve 95 is connected for fluid communication with a drain opening 80 in the separator tank 30 by a pipe or hose 90. The other end of the drain valve 95 may be connected by an exit hose or pipe 170 to a main drainage system 180. Under normal conditions, the drain valve 95 remains closed allowing the liquid 75 to accumulate in separator tank 30. When an active signal is received from the programmable logic controller 40 after probe 140 has indicated a need to empty the tank 30, the under-pressure source 55 is shut off, and the drain valve 95 opens and the liquid 75 drains into the main draining system 180. After a predetermined period of time has elapsed, the programmable logic controller 40 returns the signal along line(s) 160 to an inactive status, thus closing the drain valve 95 and, further, turns on the under-pressure source 55 by sending the appropriate signal along line(s) 110.

Figure 2:
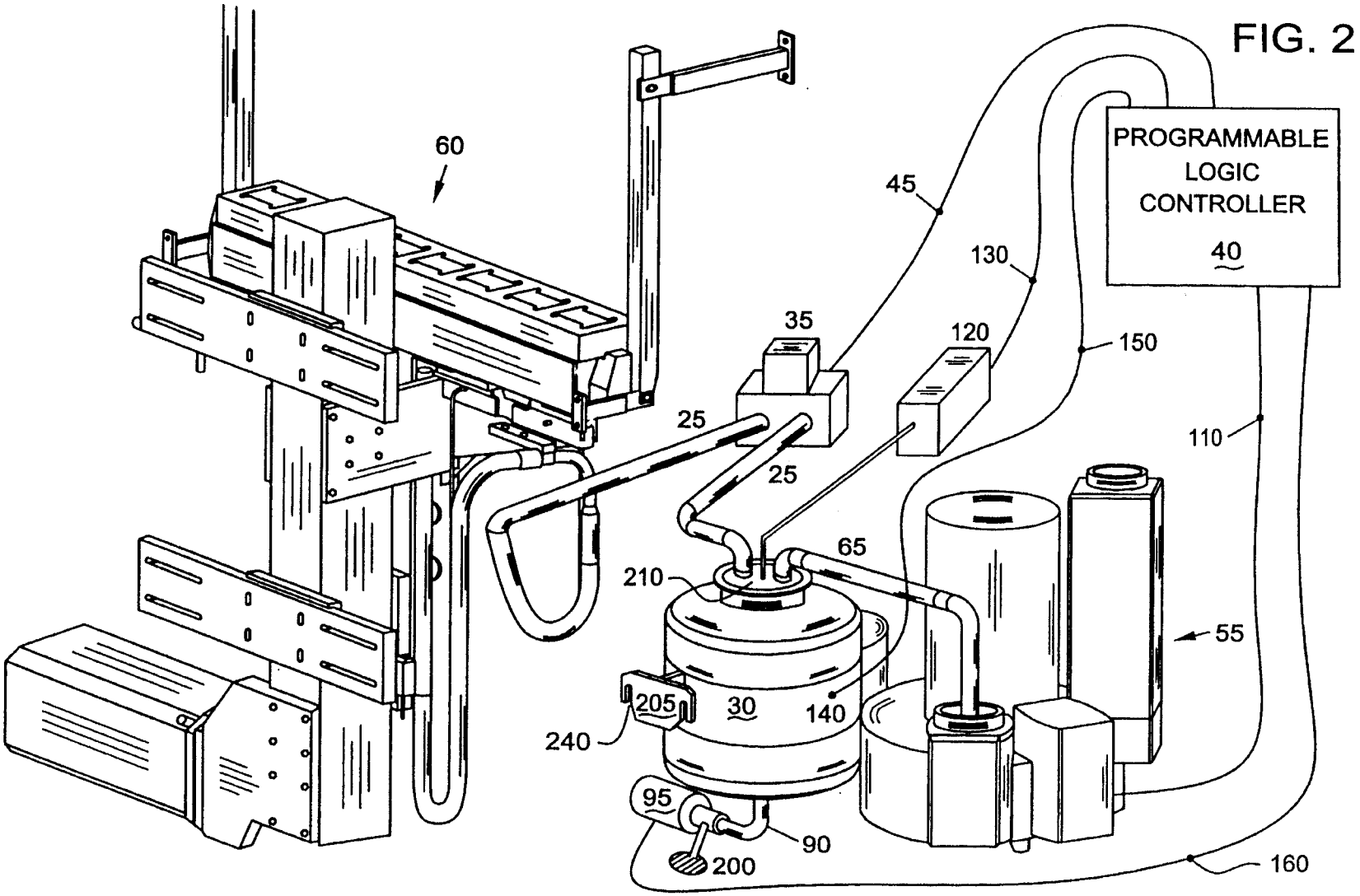
FIG. 2 is a perspective view of the physical components of the system that are shown in the block diagram of FIG. 1.

FIG. 2 is a perspective view of one physical layout of the vacuum operated processing station 10. In the illustrated embodiment, a floor drain 200 provides an exit for the liquid 75 drained from the separator tank 30. The separator tank 30 is shown with a mounting device 205 located on the side of the tank. The mounting device 205 allows the separator tank 30 to be suspended above the floor to accommodate the drain valve 95 and is comprised of two metal plates. A first plate attaches directly to the separator tank 30 and extends outward. A second plate attaches to the first mounting plate to form a "T" shaped structure. The second plate has notches 240 that allow the separator tank 30 to be readily mounted and unmounted from and to the frame of the packaging machine or the like. A lid 210 and gasket 220 attach to and seal the top of the separator tank 30. The inlet hose 25, outlet hose 40, and vacuum sensor 120, protrude vertically downward into the separator tank 30 through the lid 210.

Figure 3:
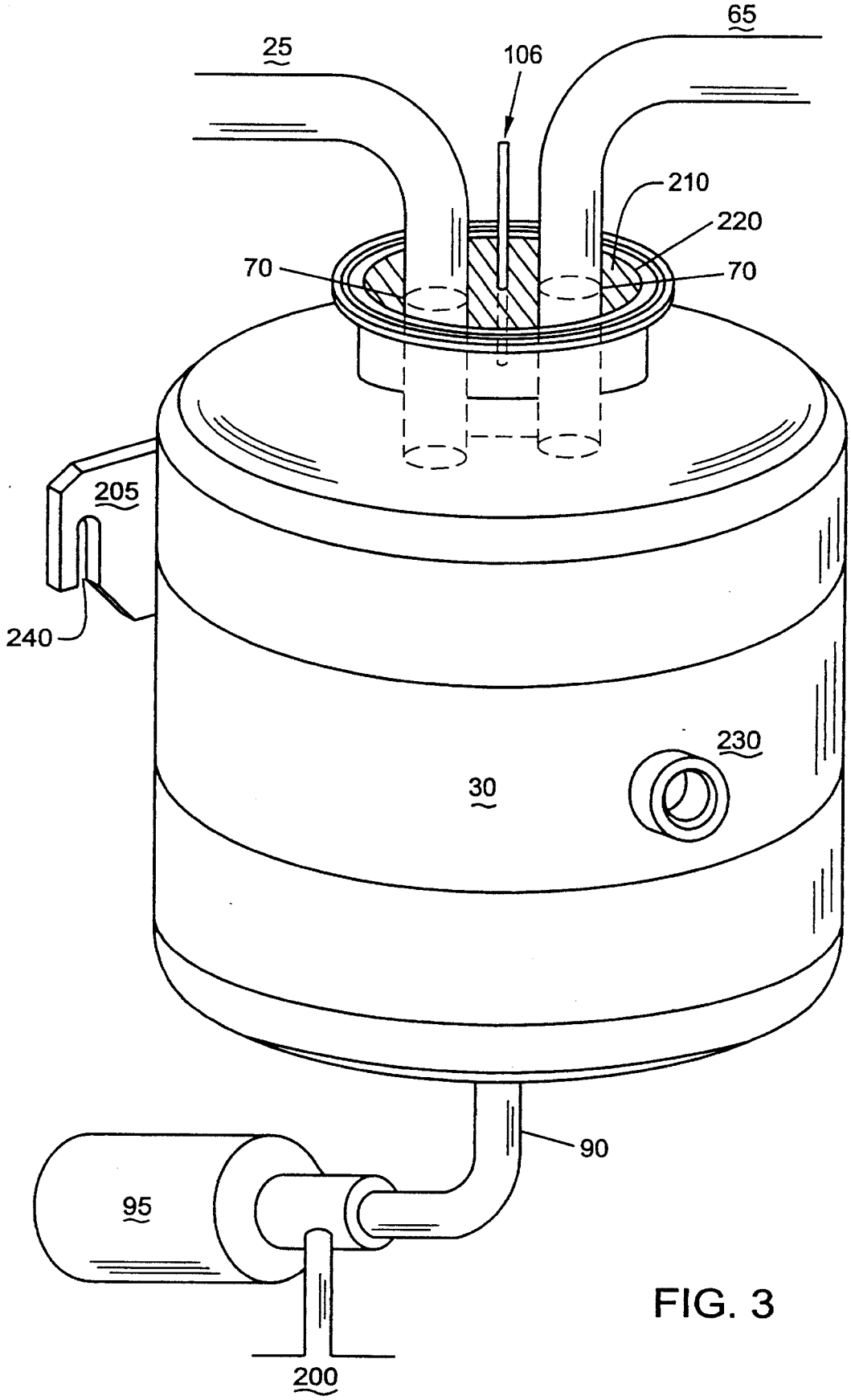
FIGS. 3 and 4 are illustrations of various aspects of the separator tank.
Figure 4:
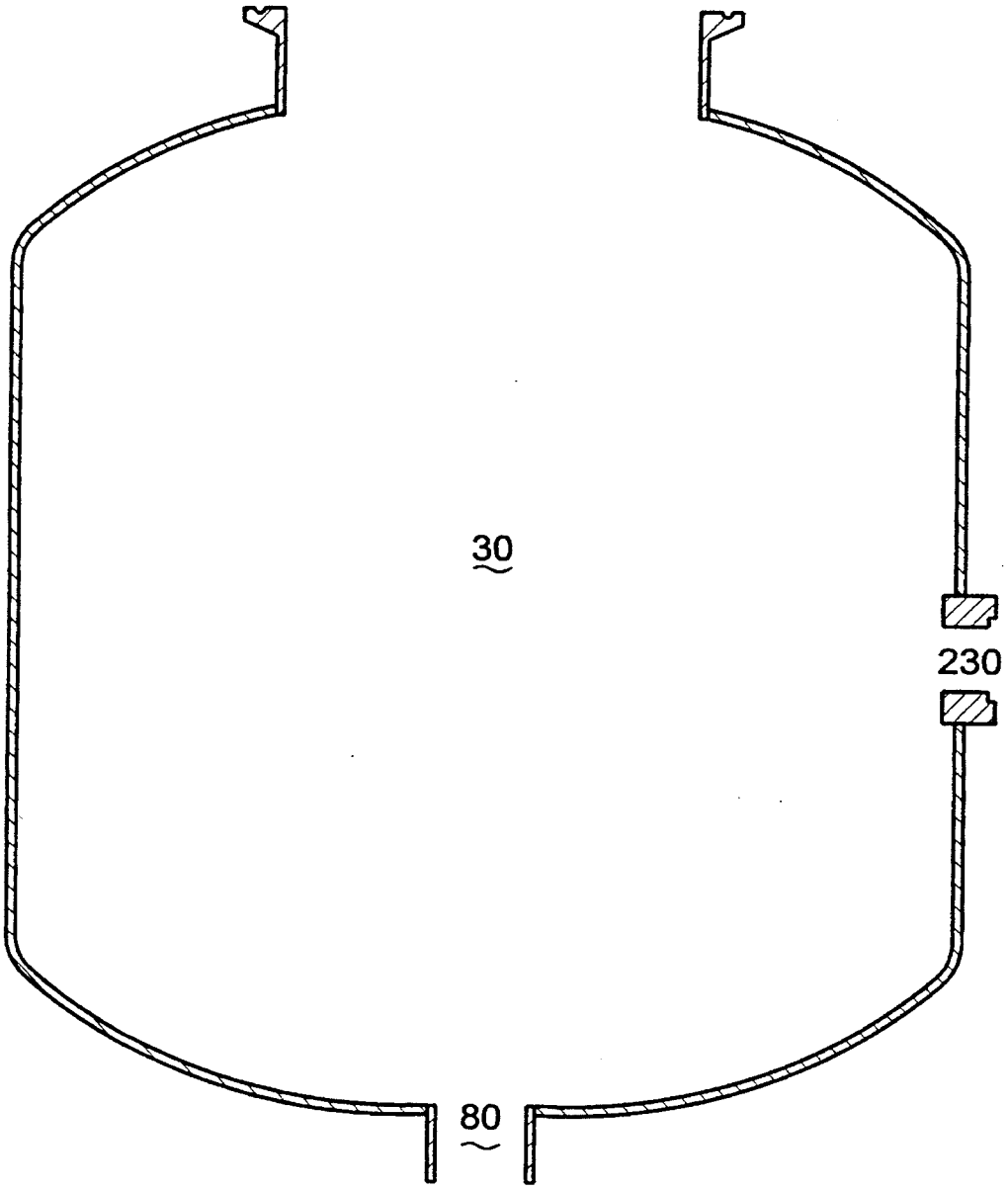

FIGS. 3 and 4 show the separator tank 30 in more detail. A circular opening 230 is shown in the side of the tank 30 at the mid region thereof. The probe 140 protrudes through the circular opening 230 into the separator tank 30 and is electrically insulated therefrom by gasket 70 that, further, seals the probe 140 within the circular opening 230 in the separator tank 30.

FIGS. 5 and 6 illustrate the operation of the shut-off valve 30 previously described in detail above.

Although the present invention has been described with reference to specific embodiments, those of skill in the art will recognize that changes may be made thereto without departing from the scope and spirit of the invention as set forth in the appended claims.

We claim:

1. A vacuum operated processing station in a packaging machine comprising:

an under-pressure source;

a vacuum operated processing apparatus for executing at least one of a plurality of processing steps to form and seal a container;

a separator tank having an inlet in fluid communication with the vacuum operated processing apparatus and an outlet in fluid communication with the under-pressure source; and level detecting means for detecting a level of a liquid in the separator tank.

2. A vacuum operated processing station as claimed in claim 1 wherein the vacuum operated apparatus is a vacuum bottom former.

3. A vacuum operated processing station as claimed in claim 1 wherein the level detecting means comprises a probe disposed at an interior portion of the separator tank.

4. A vacuum operated processing station as claimed in claim 1 and further comprising:

a controller; and a shut off valve disposed between the vacuum operated processing station and the under-pressure source, the shut off valve being controlled by the controller to operate in first and second modes, the shut off valve connecting the under-pressure source to the vacuum operated processing station in the first mode and disconnecting the under-pressure source from the vacuum operated processing station in the second mode.

5. A vacuum operated processing station as claimed in claim 1 and further comprising a vacuum sensor connected to sense the level of under-pressure inside the separator tank.

6. A vacuum operated processing station as claimed in claim 1 wherein the level detector means comprises:

a controller;

a level detector having an output signal indicative of the level of a fluid in the separator tank, the output signal being supplied for receipt by the controller;

and wherein the vacuum operated processing station further comprises a drain valve disposed at a liquid output of the separator tank and connected for control by the controller, receipt of an active signal level from the level detector by the controller causing the controller to open the drain valve.

7. A vacuum operated processing station as claimed in claim 6 wherein the controller keeps the drain valve open for a predetermined period of time after detection of the active signal level from the level detector.

8. A vacuum operated processing station in a packaging machine comprising:

an under-pressure source;

a vacuum operated processing apparatus for executing at least one of a plurality of processing steps to form and seal a container;

a separator tank having an inlet in fluid communication with the vacuum operated processing apparatus and an outlet in fluid communication with the under-pressure source;

a controller; and a shut off valve disposed between the vacuum operated processing station and the under-pressure source, the shut off valve being controlled by the controller to operate in first and second modes during execution of the at least one of a plurality of processing steps, the shut off valve connecting the under-pressure source to the vacuum operated processing station in the first mode to facilitate forming and/or sealing of the containers and disconnecting the under-pressure source from the vacuum operated processing station in the second mode to facilitate removal of the containers from the vacuum operated processing apparatus.

9. A vacuum operated processing station as claimed in claim 8 wherein the vacuum operated apparatus is a vacuum bottom former.

10. A vacuum operated processing station as claimed in claim 8 and further comprising a vacuum sensor connected to sense the level of under-pressure inside the separator tank.

11. A vacuum operated processing station as claimed in claim 8 and further comprising:

a level detector having an output signal indicative of the level of a fluid in the separator tank, the output signal being supplied for receipt by the controller; and a drain valve disposed at a liquid output of the separator tank and connected for control by the controller, receipt of an active signal level from the level detector by the controller causing the controller to open the drain valve.

12. A vacuum operated processing station as claimed in claim 11 wherein the controller keeps the drain valve open for a predetermined period of time after detection of the active signal level from the level detector.

13. A vacuum operated processing station in a packaging machine comprising:

an under-pressure source;

a vacuum operated processing apparatus for executing at least one of a plurality of processing steps to form and seal a container;

a separator tank having an inlet in fluid communication with the vacuum operated processing apparatus and an outlet in fluid communication with the under-pressure source;

a controller;

a level detector having an output signal indicative of the level of a fluid in the separator tank, the output signal being supplied for receipt by the controller; and a drain valve disposed at a liquid output of the separator tank and connected for control by the controller, receipt of an active signal level from the level detector by the controller causing the controller to open the drain valve.

14. A vacuum operated processing station as claimed in claim 13 wherein the vacuum operated apparatus is a vacuum bottom former.

15. A vacuum operated processing station as claimed in claim 13 wherein the level detector comprises a probe disposed at an interior portion of the separator tank.

16. A vacuum operated processing station as claimed in claim 13 and further comprising:

a shut off valve disposed between the vacuum operated processing station and the under-pressure source, the shut off valve being controlled by the controller to operate in first and second modes, the shut off valve connecting the under-pressure source to the vacuum operated processing station in the first mode and disconnecting the under-pressure source from the vacuum operated processing station in the second mode.

17. A vacuum operated processing station as claimed in claim 13 and further comprising a vacuum sensor connected to sense the level of under-pressure inside the separator tank.

18. A vacuum operated processing station as claimed in claim 13 wherein the controller keeps the drain valve open for a predetermined period of time after detection of the active signal level from the level detector.

19. A vacuum operated processing station in a packaging machine comprising:

an under-pressure source;

a vacuum operated processing apparatus for forming and sealing a bottom of a container;

a separator tank having an inlet in fluid communication with the vacuum operated processing apparatus and an outlet in fluid communication with the under-pressure source, the outlet being disposed at an upper portion of the separator tank to prevent fluid product from a failed bottom forming and sealing operation from being communicated to the under-pressure source.

20. A vacuum operated processing station as claimed in claim 19 wherein the vacuum operated apparatus is a vacuum bottom former comprising a plurality of cups each receiving a respective container therein to form the bottoms of the containers, each cup being in fluid communication with the separator tank inlet.

21. A vacuum operated processing station as claimed in claim 19 and further comprising level detecting means for detecting a level of a liquid in the separator tank.

22. A vacuum operated processing station as claimed in claim 21 wherein the level detecting means comprises a probe disposed at an interior portion of the separator tank.

23. A vacuum operated processing station as claimed in claim 19 and further comprising:

a controller; and a shut off valve disposed between the vacuum operated processing station and the under-pressure source, the shut off valve being controlled by the controller to operate in first and second modes, the shut off valve connecting the under-pressure source to the vacuum operated processing station in the first mode and disconnecting the under-pressure source from the vacuum operated processing station in the second mode.

24. A vacuum operated processing station as claimed in claim 19 and further comprising a vacuum sensor connected to sense the level of under-pressure inside the separator tank.

25. A vacuum operated processing station as claimed in claim 19 and further comprising:

a controller;

a level detector having an output signal indicative of the level of a fluid in the separator tank, the output signal being supplied for receipt by the controller; and a drain valve disposed at a liquid output of the separator tank and connected for control by the controller, receipt of an active signal level from the level detector by the controller causing the controller to open the drain valve.

26. A vacuum operated processing station as claimed in claim 25 wherein the controller keeps the drain valve open for a predetermined period of time after detection of the active signal level from the level detector.

27. A vacuum operated processing station in a packaging machine comprising:

an under-pressure source;

a vacuum operated processing apparatus for executing at least one of a plurality of processing steps to form and seal a container;

a separator tank having an inlet in fluid communication with the vacuum operated processing apparatus and an outlet in fluid communication with the under-pressure source, the outlet being disposed at an upper portion of the separator tank to prevent liquid entering the separator tank from being communicated to the under-pressure source;

a programmable controller;

a level detector having an output signal indicative of the level of a fluid in the separator tank, the output signal being supplied for receipt by the programmable controller:

a drain valve disposed at a liquid output of the separator tank and connected for control by the controller, receipt of an active signal level from the level detector by the controller causing the controller to open the drain valve.

28. A vacuum operated processing station as claimed in claim 27 wherein the vacuum operated apparatus is a vacuum bottom former comprising a plurality of cups each receiving a respective container therein to form the bottoms of the containers, each cup being in fluid communication with the separator tank inlet.

29. A vacuum operated processing station as claimed in claim 27 and further comprising a shut off valve disposed between the vacuum operated processing station and the under-pressure source, the shut off valve being controlled by the controller to operate in first and second modes during execution of the at least one of a plurality of processing steps, the shut off valve connecting the under-pressure source to the vacuum operated processing station in the first mode to facilitate forming and/or sealing of the containers and disconnecting the under-pressure source from the vacuum operated processing station in the second mode to facilitate removal of the containers from the vacuum operated processing apparatus.

30. A vacuum operated processing station as claimed in claim 27 wherein the level detecting means comprises a probe disposed at an interior portion of the separator tank.

31. A vacuum operated processing station as claimed in claim 29 and further comprising a vacuum sensor providing an output signal to the controller that is indicative of the level of under-pressure inside the separator tank, detected pressure in the separator tank rising above a threshold level when the shut-off valve is in the first mode thereby indicating to the controller that an error has occurred with respect to the vacuum operated processing.

32. A vacuum operated processing station as claimed in claim 27 wherein the controller keeps the drain valve open for a predetermined period of time after detection of the active signal level from the level detector.

33. A vacuum operated processing station as claimed in claim 31 wherein the vacuum operated apparatus is a vacuum bottom former comprising a plurality of cups each receiving a respective container therein to form the bottoms of the containers, each cup being in fluid communication with the separator tank inlet, a failure of one or more of the containers to properly engage the respective cups causing the detected pressure to rise above the threshold level.

34. A vacuum operated processing station as claimed in claim 29 wherein the vacuum operated apparatus is a vacuum bottom former comprising a plurality of cups each receiving a respective container therein to form the bottoms of the containers, each cup being in fluid communication with the separator tank inlet, the programmable controller controlling the shut off valve to be in the first state to allow an under-pressure in the cups to drive the containers into the cups and controlling the shut off valve to be in the second state to facilitate removal of the containers from the cups.

* * * * *

UNITED STATES PATENT AND TRADEMARK OFFICE

CERTIFICATE OF CORRECTION

PATENT NO. : 5,548,944

DATED : August 27, 1996

INVENTOR(S) : Richard Prochut, et. al.

It is certified that error appears in the above-indentified patent and that said Letters Patent is hereby corrected as shown below:

IN COLUMN 1, LINE 39

Cancel "canon" and insert --carton-- therefor.

Signed and Sealed this

Eighth Day of April, 1997

*Attest:*

*Attesting Officer*

BRUCE LEHMAN

*Commissioner of Patents and Trademarks*